US005826595A

United States Patent [19]

Ramm et al.

[11] Patent Number: 5,826,595

[45] Date of Patent: Oct. 27, 1998

[54] METHOD OF DRYING ONE'S HAIR

[76] Inventors: Teri J. Ramm; Robert P. Ramm, both of 12700 Eaton Cir., Leawood, Kans. 66209

[21] Appl. No.: 2,601

[22] Filed: Jan. 5, 1998

[51] Int. Cl.[6] ..... A45D 24/00

[52] U.S. Cl. ..... 132/200; 2/159; 34/283

[58] Field of Search ..... 132/200; 2/159, 2/167; 15/227; 34/283

[56] References Cited

U.S. PATENT DOCUMENTS

| | | | |
|---|---|---|---|
| 2,722,706 | 11/1955 | Chopp | 15/227 |
| 3,128,472 | 4/1964 | Raney | 15/227 |
| 4,766,914 | 8/1988 | Briggs | 2/159 |
| 4,843,652 | 7/1989 | Kuwahara | 2/159 |

*Primary Examiner*—Todd E. Manahan
*Assistant Examiner*—Eduardo C. Robert
*Attorney, Agent, or Firm*—Hovey, Williams, Timmons & Collins

[57] ABSTRACT

In the preferred method of drying one's hair, a glove of moisture absorbent material is worn on each hand. The user alternates between running the glove of one hand through the wet hair and holding a hair dryer in the other hand. The hot air from the dryer is directed onto both the hair in the vicinity of the glove and onto the glove itself in order for the hot air to dry the hair and in order for the hot air to maintain the moisture-absorbency of the glove so that the hot air and glove cooperate to speed the drying process.

7 Claims, 2 Drawing Sheets

METHOD OF DRYING ONE'S HAIR

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of drying the hair of a person. More particularly, the invention is concerned with a method in which a glove of moisture absorbent material is worn on each hand. The user alternates between running the glove of one hand through the wet hair and holding a hair dryer in the other hand so that the hot air and glove cooperate to speed the drying process.

2. Description of the Prior Art

As those skilled in the art appreciate, Traditional methods of drying one's hair include the use of a towel or a hair dryer. Both methods are time-consuming and tedious, especially for those persons with long hair.

SUMMARY OF THE INVENTION

The present invention solves the prior art problems mentioned above and provides a distinct advance in the state of the art. In particular, the hair drying method hereof substantially speeds the hair drying process.

In the preferred method of drying one's hair, a glove of moisture absorbent material is worn on each hand. The user alternates between running the glove of one hand through the wet hair and holding a hair dryer in the other hand. The hot air from the dryer is directed onto both the hair in the vicinity of the glove and onto the glove itself in order for the hot air to dry the hair and in order for the hot air to maintain the moisture-absorbency of the glove so that the hot air and glove cooperate to speed the drying process.

DETAILED DESCRIPTION OF THE PREFERRED EMBODIMENT

Figure 1:
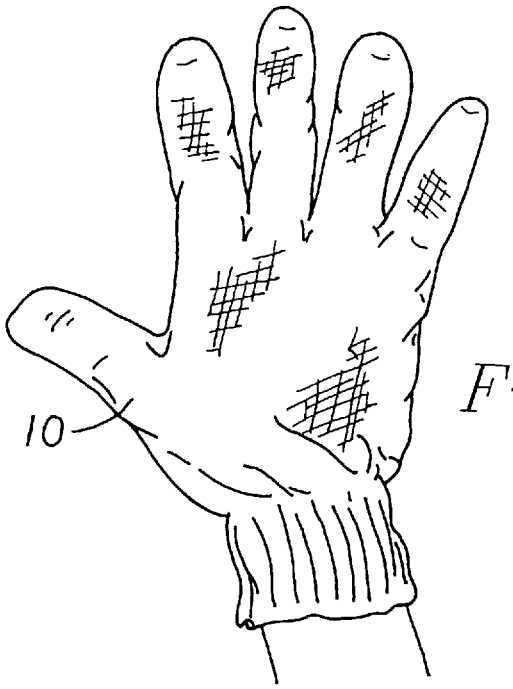
FIG. 1 is a pictorial view of the preferred form-fitting hand covering used in the present invention.

FIG. 1 illustrates form-fitting, moisture-absorbent hand covering 10, preferably in the form of a glove composed of terry cloth material. It will also be appreciated that covering 10 could be in the form of a mitt and could be constructed of an inner, waterproof layer covered with moisture absorbent material such as cotton or highly absorbent, synthetic materials. Also, hand covering 10 could be composed of a paper-based material and thereby disposable.

Figure 2:
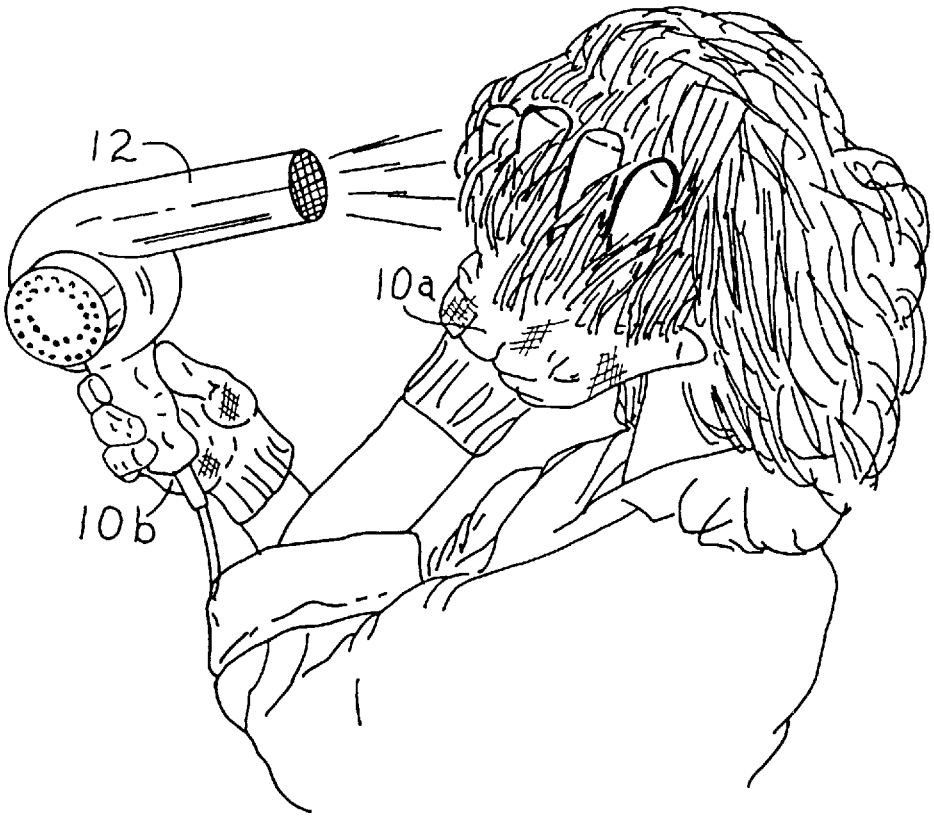
FIG. 2 is a pictorial illustration of a person implementing the method of the present invention using the hand covering of FIG. 1.

In the preferred method as illustrated in FIG. 2, two hand coverings 10 are used, individually designated as coverings 10*a* and 10*b*. As shown, a person with wet hair to be dried dons covering 10*a* on the left hand and covering 10*b* on the right hand.

In use, the user holds a conventional hair dryer 12 in one hand, such as the right hand as shown in FIG. 2, and uses the left hand to run covering 10*a* through the wet hair. It is preferred that a combing motion be used so that fingers of covering 10*a* intimately contact the wet hair in order to bring more surface area into moisture absorbing contact with the wet hair in order to dry the hair.

While running hand covering 10*a* through the hair, the user moves hair dryer 12 in a back and forth motion to direct hot air therefrom onto the wet hair in the vicinity of covering 10*a* and also to direct the hot air onto covering 10*a*. Using this method, the hot air dries the hair and also dries covering 10*a* in order to maintain the moisture absorbency of covering 10*a* during the drying process.

In this way, the hot air and covering 10*a* cooperate to speed the hair drying process. During the drying process, the user alternates dryer 12 between hands and alternates the use of coverings 10*a* and 10*b* on the wet hair so that both coverings are used to full effect.

Figure 3:
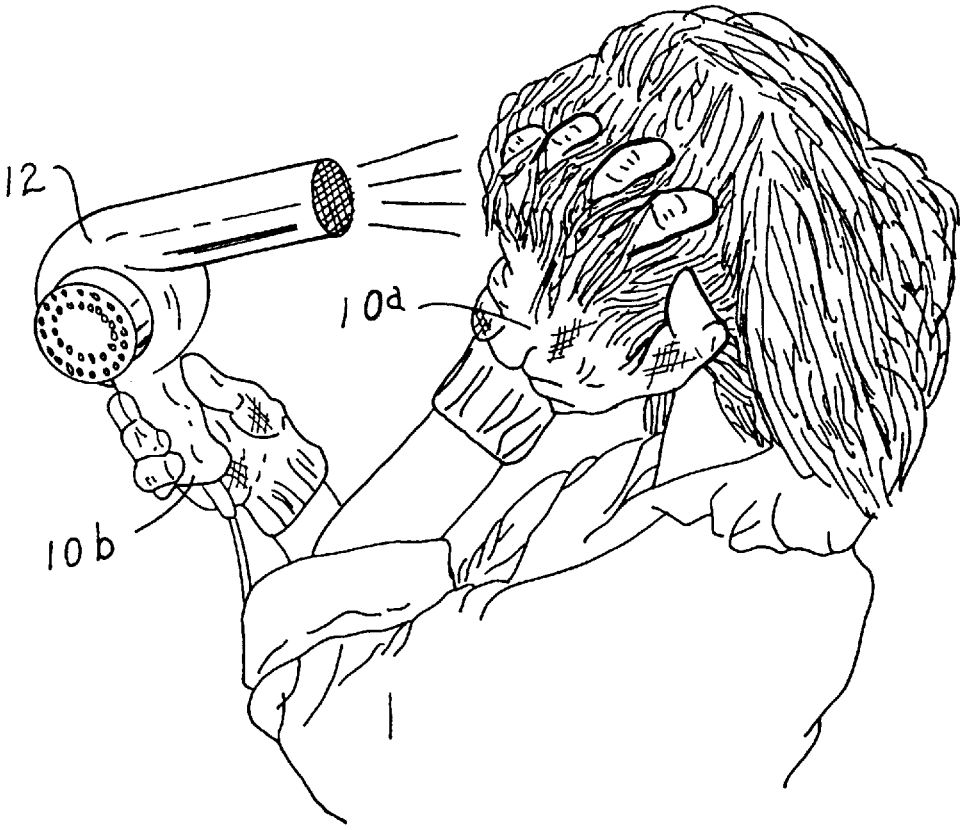
FIG. 3 is a pictorial illustration similar to FIG. 2 but showing an additional technique.

FIG. 3 illustrates another technique for implementing the method of the present invention. This is the technique commonly known as "scrunching" in which the hand manipulating the hair is formed into a loose fist and pulled through the hair. This tends to compress the hair between the fingers of the covering thereby increasing the rate of moisture absorption from the hair to the covering. Moreover, this technique tends to fluff the hair during the drying process in order to add additional body, fullness and curl.

As described above, the present invention substantially speeds the hair drying process. Typically, it has been found that the drying time is reduced to about half using the method of the present invention as compared to prior art methods.

Also, the reduced drying time of the present invention reduces split ends and other hair damage, which has been a problem in the prior art because of excessive heat and the longer drying times. Moreover, the user can manipulate covering 10, such as by slipping or pulling the hair between the fingers, to style the hair and to add fullness and body during the drying process.

It will also be appreciated that a hair stylist can use the method of the present invention for drying the hair of another person. This allows styling to occur during the drying process thereby improving the efficiency of the stylist and reducing the amount of time that a customer must remain in the salon.

Those skilled in the art will appreciate that the present invention encompasses many variations in the preferred embodiment described herein.

Having thus described this embodiment, the following is claimed as new and desired to be secured by Letters Patent:

1. A method of drying a person's hair comprising the steps of:

(a) donning a form-fitting hand covering on at least one hand of a person, said covering being moisture absorbent;

(b) repeatedly running said covering through a person's hair in order to absorb moisture therefrom and dry the hair; and (c) during step (b) directing hot air from a hair dryer onto both the wet hair in the vicinity of said covering and onto said covering in order for the hot air to dry the hair and in order to dry said covering for maintaining the moisture absorbency thereof so that the hot air and covering cooperate to speed the drying of the person's hair.

2. The method as set forth in claim 1, step (a) wherein said form-fitting hand covering is a glove.

3. The method as set forth in claim 1, step (a) including the step of donning said covering composed of terry cloth.

4. The method as set forth in claim 1, step (a) including the step of donning a moisture-absorbent, form-fitting hand covering on each of the hands of a person, step (c) including the step of alternating the holding of said hair dryer in one of the hands while running the covering on the other of the hands through the person's hair.

5. The method as set forth in claim 1, step (a) including the step of donning said covering on at least one hand of the person whose hair is to be dried.

6. The method as set forth in claim 1, step (b) including the step of scrunching the hair.

7. A method of drying a person's hair comprising the steps of:

(a) donning form-fitting hand coverings on the respective hands of a person, said covering being moisture absorbent and configured as a glove having fingers;

(b) alternately running said coverings through a person's hair with portions of the hair between the fingers of the coverings in order to absorb moisture and dry the hair; and (c) during step (b) alternating the holding of a hair dryer in one of the person's hands and directing hot air from said hair dryer onto both the wet hair in the vicinity of said covering on the other hand and onto said covering in order for the hot air to dry the hair and in order to dry said covering for maintaining the moisture absorbency thereof so that the hot air and glove cooperate to speed the drying of the person's hair.

* * * * *

UNITED STATES PATENT AND TRADEMARK OFFICE

CERTIFICATE OF CORRRECTION

PATENT NO. : 5,826,595
DATED : October 27, 1998
INVENTOR(S) : Teri J. Ramm, et al.

It is certified that error appears in the above-identified patent and that said Letters Patent is hereby corrected as shown below:

On the title page item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 0 | 7 | 1 | 9 | 2 | 1 | 2/7/78 | Jury, D.E. | | | |
| | | 4 | 7 | 9 | 7 | 9 | 6 | 7 | 1/17/89 | Lengers, H.L. | | | |
| | | 4 | 8 | 9 | 3 | 3 | 7 | 2 | 1/16/90 | Wenzel, R.E. | | | |
| | | 4 | 9 | 0 | 2 | 2 | 8 | 3 | 2/20/90 | Rojko, et al. | | | |
| | | 5 | 4 | 7 | 3 | 7 | 8 | 9 | 12/12/95 | Oster, A. L. | | | |
| | | | | | | | | | | | | | |

Signed and Sealed this

Twenty-seventh Day of April, 1999

*Attest:*

Q. TODD DICKINSON

*Attesting Officer*

*Acting Commissioner of Patents and Trademarks*